US010365596B1

(12) United States Patent
Tanaka et al.

(10) Patent No.: US 10,365,596 B1
(45) Date of Patent: Jul. 30, 2019

(54) FUSER INCLUDING ENDLESS BELT AND SLIDING SHEET

(71) Applicant: Brother Kogyo Kabushiki Kaisha, Nagoya-shi, Aichi-ken (JP)

(72) Inventors: Tokifumi Tanaka, Komaki (JP); Hideki Kanada, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/137,646

(22) Filed: Sep. 21, 2018

(30) Foreign Application Priority Data

Feb. 5, 2018 (JP) ..... 2018-018522

(51) Int. Cl.
*G03G 15/20* (2006.01)

(52) U.S. Cl.
CPC ..... *G03G 15/2053* (2013.01); *G03G 15/2064* (2013.01); *G03G 2215/2009* (2013.01); *G03G 2215/2035* (2013.01)

(58) Field of Classification Search
CPC ..... G03G 15/2053
See application file for complete search history.

(56) References Cited

U.S. PATENT DOCUMENTS

| | | | |
|---|---|---|---|
| 7,379,697 | B2 | 5/2008 | Ito et al. |
| 8,032,068 | B2 | 10/2011 | Hanyu et al. |
| 8,195,072 | B2 | 6/2012 | Okuno |
| 8,909,116 | B2 | 12/2014 | Ohtsu |
| 8,958,733 | B2 | 2/2015 | Nishida et al. |
| 9,002,254 | B2 | 4/2015 | Ohtsu |
| 9,008,560 | B2 | 4/2015 | Otsu |
| 2006/0083567 | A1 | 4/2006 | Ito et al. |
| 2009/0014942 | A1 | 1/2009 | Okuno |
| 2009/0208263 | A1 | 8/2009 | Hanyu et al. |

(Continued)

FOREIGN PATENT DOCUMENTS

| | | | |
|---|---|---|---|
| JP | 2003-076178 | A | 3/2003 |
| JP | 2004-37552 | A | 2/2004 |

(Continued)

OTHER PUBLICATIONS

Feb. 7, 2019—(US) Non-Final Office Action—U.S. Appl. No. 16/137,672.

(Continued)

*Primary Examiner* — Sevan A Aydin
(74) *Attorney, Agent, or Firm* — Banner & Witcoff, Ltd.

(57) ABSTRACT

A fuser includes a rotatable member, a belt, a pressure member, and a sliding member. The pressure member sandwiches the belt together with the rotatable member to form a nip portion. The sliding member is sandwiched between an inner peripheral surface of the belt and the pressure member. The sliding member includes a front surface, which faces the inner peripheral surface of the belt. The front surface includes a plurality of first dimples and a plurality of second dimples. The first dimples are arranged in a zone corresponding to a first part of the nip portion. The second dimples are arranged in a zone corresponding to a second part of the nip portion, to which a pressure smaller than a pressure applied in the first part is applied. Each of the first dimples is of a shape that can release lubricant more easily than each of the second dimples.

20 Claims, 12 Drawing Sheets

(56) References Cited

U.S. PATENT DOCUMENTS

| | | | | |
|---|---|---|---|---|
| 2013/0189007 | A1 | 7/2013 | Ohtsu | |
| 2013/0266354 | A1 | 10/2013 | Nishida et al. | |
| 2014/0086651 | A1 | 3/2014 | Otsu | |
| 2014/0205332 | A1 | 7/2014 | Otsu | |
| 2015/0030362 | A1* | 1/2015 | Bae | G03G 15/2028 399/329 |
| 2016/0274519 | A1* | 9/2016 | Lim | G03G 15/2053 |
| 2017/0097598 | A1* | 4/2017 | Kudo | G03G 15/2053 |
| 2017/0176905 | A1* | 6/2017 | Suzuki | G03G 15/2053 |
| 2017/0285537 | A1* | 10/2017 | Onaka | G03G 15/2053 |
| 2018/0292771 | A1* | 10/2018 | Kudo | G03G 15/2053 |
| 2018/0299808 | A1* | 10/2018 | Suzuki | G03G 15/2053 |

FOREIGN PATENT DOCUMENTS

| | | | |
|---|---|---|---|
| JP | 2006-119263 | A | 5/2006 |
| JP | 2007-147865 | A | 6/2007 |
| JP | 2009-15227 | A | 1/2009 |
| JP | 2009-198567 | A | 9/2009 |
| JP | 2009-229494 | A | 10/2009 |
| JP | 2013-148837 | A | 8/2013 |
| JP | 2013-218175 | A | 10/2013 |
| JP | 2014-63067 | A | 4/2014 |
| JP | 2014-139641 | A | 7/2014 |

OTHER PUBLICATIONS

Feb. 26, 2019—(US) Non-Final Office Action—U.S. Appl. No. 16/137,664.

* cited by examiner

FUSER INCLUDING ENDLESS BELT AND SLIDING SHEET

CROSS-REFERENCE TO RELATED APPLICATION

This application claims priority from Japanese Patent Application No. 2018-018522 filed on Feb. 5, 2018, the content of which is incorporated herein by reference in its entirety.

TECHNICAL FIELD

Aspects disclosed herein relate to a fuser for fusing a toner image onto a recording medium.

BACKGROUND

A known fuser includes a heat roller, an endless belt having lubricant on its inner circumferential surface, a nip forming member, and a sliding sheet. The nip forming member and the heat roller sandwich an endless belt therebetween to form a nip portion. The sliding sheet is disposed between a portion of an inner circumferential surface of the endless belt and the nip forming member. The sliding sheet has a surface that contacts a portion of the inner circumferential surface of the endless belt. The surface of the sliding sheet has a plurality of dimples for reducing sliding resistance occurring between the surface of the sliding sheet and the endless belt during rotation of the endless belt.

SUMMARY

A fuser includes a rotatable member, a belt, a pressure member, and a sliding member. The pressure member sandwiches the belt together with the rotatable member to form a nip portion. The sliding member is sandwiched between an inner peripheral surface of the belt and the pressure member. The sliding member includes a front surface, which faces the inner peripheral surface of the belt. The front surface includes a plurality of first dimples and a plurality of second dimples. The first dimples are arranged in a first zone corresponding to a first portion of the nip portion, to which a first pressure is to be applied. The second dimples are arranged in a second zone corresponding to a second portion of the nip portion, to which a second pressure smaller than the first pressure is to be applied.

In one aspect, the first dimples may comprise a first upstream dimple and a first downstream dimple, positioned downstream from the first upstream dimple in a moving direction of the belt at the nip portion. A first ridge portion may be formed between the first upstream dimple and the first downstream dimple. The second dimples may comprise a second upstream dimple and a second downstream dimple positioned downstream from the second upstream dimple in the moving direction. A second ridge portion may be formed between the second upstream dimple and the second downstream dimple. A first angle formed between the first upstream dimple and the first ridge portion may be greater than a second angle formed between the second upstream dimple and the second ridge portion.

In another aspect, the first dimples may comprise a first upstream dimple and a first downstream dimple, positioned downstream from the first upstream dimple in a moving direction of the belt at the nip portion. A first ridge portion may be formed between the first upstream dimple and the first downstream dimple. The second dimples may comprise a second upstream dimple and a second downstream dimple positioned downstream from the second upstream dimple in the moving direction. A second ridge portion may be formed between the second upstream dimple and the second downstream dimple. Additionally, a slope of an edge of the first upstream dimple in the moving direction relative to the first ridge portion may be steeper than a slope of an edge of the second upstream dimple in the moving direction relative to the second ridge portion.

In another aspect, an opening of each of the first dimples and an opening of each of the second dimples may have same size, and a depth of each of the first dimples may be less than a depth of each of the second dimples.

DETAILED DESCRIPTION

An illustrative embodiment will be described with reference to the accompanying drawings.

Figure 1:
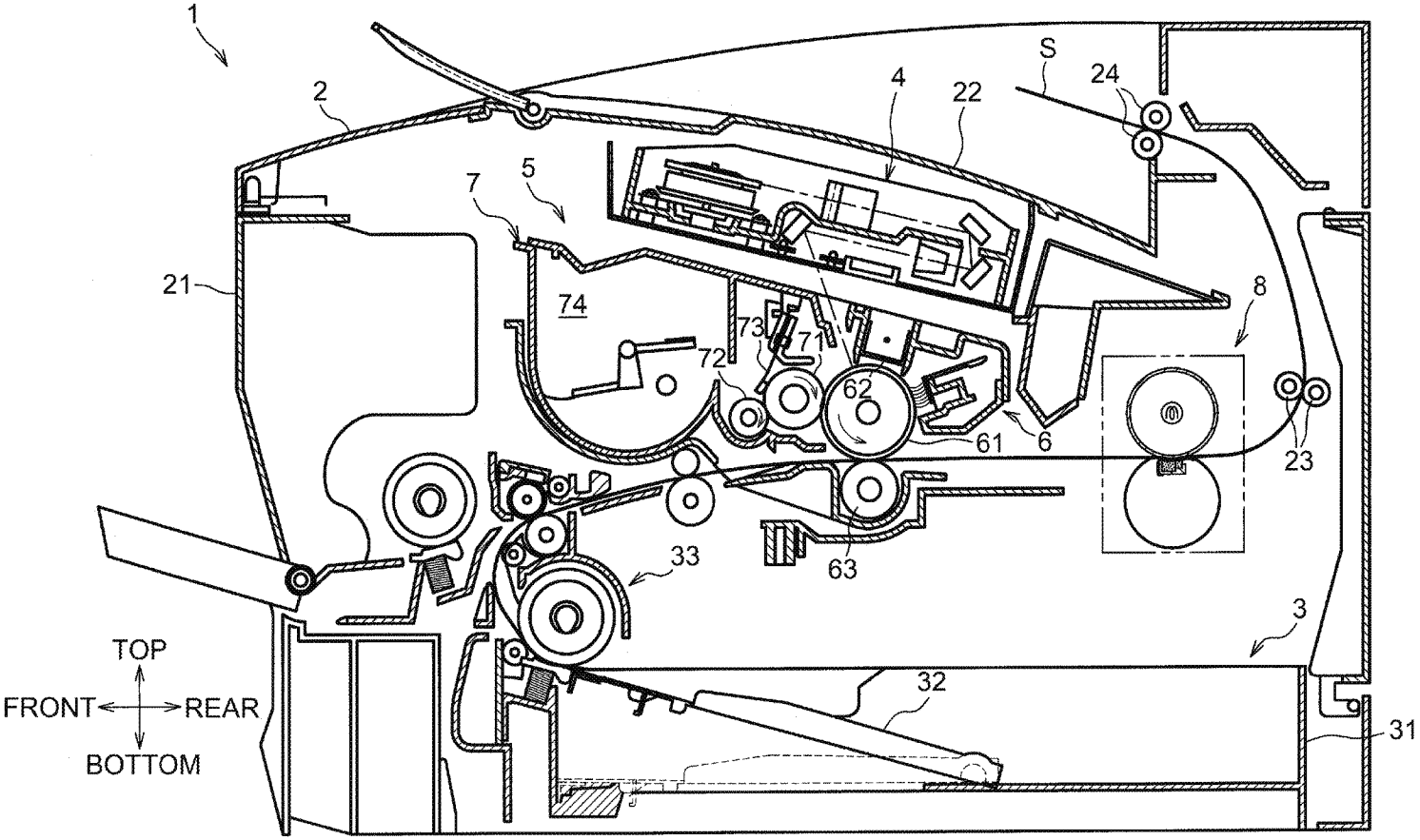
FIG. 1 is a sectional view illustrating a laser printer including a fuser in an illustrative embodiment according to one or more aspects of the disclosure.

As illustrated in FIG. 1, the laser printer 1 includes a housing 2. The laser printer 1 further includes a feed unit 3, an exposure device 4, a process cartridge 5, and a fuser 8 in the housing 2.

The feed unit 3 is disposed in a lower portion of the housing 2. The feed unit 3 includes a feed tray 31, a sheet support plate 32, and a sheet feed mechanism 33. The feed tray 31 is configured to accommodate one or more sheets S. The sheet support plate 32 is configured to raise the one or more sheets S in the feed tray 31. The sheet feed mechanism 33 is configured to feed, one by one, the raised one or more sheets S to the process cartridge 5.

The exposure device 4 is disposed in an upper portion of the housing 2. The exposure device 4 includes a light emitter (not illustrated), a polygon mirror, lenses, and reflectors (whose reference numerals are omitted). In the exposure device 4, the light source emits a laser beam based on image data to scan a circumferential surface of a photosensitive drum 61 at a high speed, thereby exposing a portion of the circumferential surface of the photosensitive drum 61.

The housing 2 has an opening defined therein. The housing 2 further includes a front cover 21 for covering the opening. The process cartridge 5 is detachably attachable to the housing 2 through the opening that is exposed when the front cover 21 is open. In a state where the process cartridge 5 is attached to the housing 2, the process cartridge 5 is placed below the exposure device 4. The process cartridge 5 includes a drum unit 6 and a developing unit 7. The drum unit 6 includes the photosensitive drum 61, a charger 62, and a transfer roller 63. The developing unit 7 is detachably attachable to the drum unit 6. The developing unit 7 includes a developing roller 71, a supply roller 72, a blade 73, and a storage 74 for storing toner.

In the process cartridge 5, the charger 62 uniformly charges the circumferential surface of the photosensitive drum 61. The photosensitive drum 61 is then formed with an electrostatic latent image on its circumferential surface based on image data by exposure with a laser beam by the exposure device 4. The supply roller 71 supplies toner onto a circumferential surface of the developing roller 71 from the storage 74. The developing roller 71 and the blade 73 cause toner to become a thin layer having uniform thickness. The developing roller 71 thus holds the thin layer of toner on its circumferential surface. The developing roller 71 further supplies toner onto the electrostatic latent image formed on the circumferential surface of the photosensitive drum 61. The photosensitive drum 61 thus holds a toner image, which is a visualized electrostatic latent image, on its circumferential surface. Thereafter, the transfer roller 63 transfers the toner image onto a sheet S from the circumferential surface of the photosensitive drum 61 when the sheet S passes between the photosensitive drum 61 and the transfer roller 63.

Figure 2A:
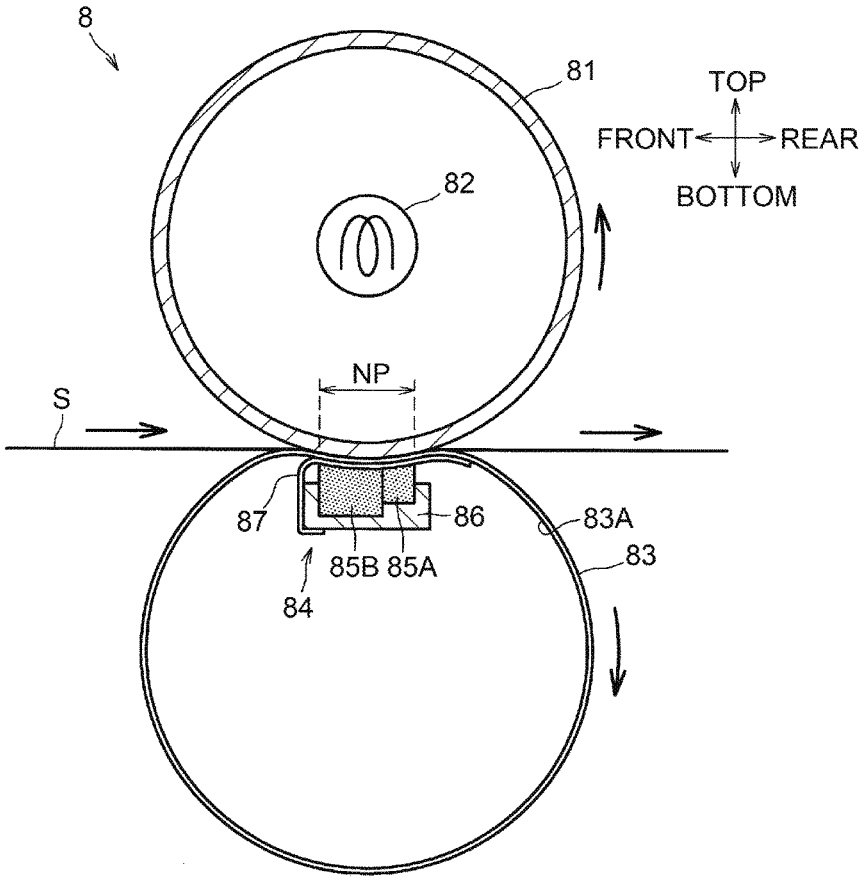
FIG. 2A is a cross-sectional view illustrating the fuser in the illustrative embodiment according to one or more aspects of the disclosure.

As illustrated in FIG. 2A, the fuser 8 includes a heat roller 81, a heater 82, an endless belt 83, and a pressure unit 84. The head roller 81 is an example of a cylindrical member. One of the heat roller 81 and the pressure unit 84 is urged toward the other to form a nip portion NP between the heat roller 81 and the endless belt 83.

In the following explanation, a direction in which the endless belt 83 extends along its rotational axis may be referred to as a "width direction". A direction in which the endless belt 83 moves at the nip portion NP when the fuser 8 fuses a toner image onto a sheet S may be referred to as a "moving direction". A direction in which the head roller 81 and the pressure unit 84 (more specifically, a pressure pad 85A) face each other may be referred to as a "facing direction". In the illustrative embodiment, the width direction corresponds to a right-left direction. The moving direction corresponds to a front-rear direction of the laser printer 1. The facing direction corresponds to a top-bottom direction of the laser printer 1.

The heat roller 81 includes a hollow cylindrical body. For example, the heat roller 81 may include a base tube made of metal such as aluminum. The base tube may have a release layer formed on its outer circumferential surface. The release layer may be made of, for example, fluorine resin. The heat roller 81 is configured to receive a driving force transmitted from a motor (not illustrated) to rotate counterclockwise in FIG. 2. The heat roller 81 is in contact with a portion of an outer circumferential surface of the endless belt 83.

The heater 82 is configured to heat the heat roller 81. The heater 82 is disposed in an internal space of the heat roller 81. The heater 82 may be, for example, a halogen lamp that emits light by energization to heat the heat roller 81 by its radiant heat.

The endless belt 83 may be a flexible cylindrical member. The endless belt 83 may include, for example, a base made of metal such as stainless steel or resin such as polyimide resin. The base may have a release layer formed on its outer circumferential surface. The release layer may be made of fluorine resin. The endless belt 83 is configured to rotate clockwise in FIG. 2 by rotation of the heat roller 81.

The endless belt 83 has an inner circumferential surface 83A which may be lubricated by lubricant such as grease. The lubricant may increase slidability between the inner circumferential surface 83A of the endless belt 83 and the pressure unit 84. This may thus enable the endless belt 83 to rotate smoothly relative to the pressure unit 84.

The pressure unit 84 includes pressure pads 85A and 85B, a holder 86, and a sliding sheet 87. The holder 86 holds the pressure pads 85A and 85B. The pressure pads 85A and 85B are an example of a nip forming member.

The pressure pad 85A is an example of a first pressure portion. The pressure pad 85B is an example of a second pressure portion. The pressure pad 85A and the pressure pad 85B are separate parts.

The pressure pads 85A and 85B are disposed inside a loop of the endless belt 83. That is, the pressure pads 85A and 85B are surrounded by the endless belt 83. The pressure pads 85A and 85B may include an elastic member made of, for example, rubber. The pressure pads 85A and 85B sandwich a portion of the endless belt 83 together with the heat roller 81 to form the nip portion NP therebetween. This configuration may thus enable application of heat and pressure to a sheet S having a toner image while the sheet S passes the nip portion NP, thereby fusing the toner image onto the sheet S.

The pressure pad 85A is disposed downstream from the pressure pad 85B in the moving direction. The pressure pad 85A is in contact with the pressure pad 85B. While having the same dimension in the width direction, the pressure pad 85A has smaller dimensions both in the facing direction and in the moving direction than the pressure pad 85B. Such a configuration may thus enable the pressure pad 85A to apply a first pressure to the sliding sheet 87 and the pressure pad 85B to apply a second pressure to the sliding sheet 87. The second pressure is weaker than the first pressure.

In the illustrative embodiment, while the pressure pads 85A and 85B are made of the same material, the pressure pads 85A and 85B have different shapes, thereby enabling the pressure pads 85A and 85B to apply different pressures, respectively, to the sliding sheet 87. Nevertheless, in other embodiments, for example, the pressure pads 85A and 85B may be made of different materials while having the same shape. Such a configuration may also enable the pressure pads 85A and 85B to apply different nip pressures, respectively, to the sliding sheet 87.

The sliding sheet 87 may have a rectangular shape. The sliding sheet 87 is used for reducing friction resistance occurring between the pressure pad 85A and the endless belt 83 and between the pressure pad 85B and the endless belt 83 when the endless belt 83 rotates. The sliding sheet 87 may be made of resin containing polyimide, and has elasticity. The sliding sheet 87 is sandwiched between the inner circumferential surface 83A of the endless belt 83 and the pressure pad 85A/pressure pad 85B pair at the nip portion NP.

For example, the sliding sheet 87 has one end (e.g., an upstream end) attached to an upstream end portion of the holder 86 in the moving direction. More specifically, for example, the sliding sheet 87 extends upward along an external shape of the upstream end portion of the holder 86 in the moving direction from a lower surface of the holder 86, and bends toward the rear. The sliding sheet 87 further extends over the holder 86 while being disposed between the pressure pad 85A/pressure pad 85B pair and the endless belt 83. The other end (e.g., a downstream end) of the sliding sheet 87 is not fixed. Nevertheless, the other end of the sliding sheet 87 is pressed against and in contact with the inner circumferential surface 83A of the endless belt 83 by elasticity of the sliding sheet 87 itself.

In the illustrative embodiment, the other end of the sliding sheet 87 is not fixed. Nevertheless, in other embodiments, for example, the other end of the sliding sheet 87 may be fixed to the holder 86. In still other embodiments, for example, the sliding sheet 87 may be made of another material.

Figure 2B:
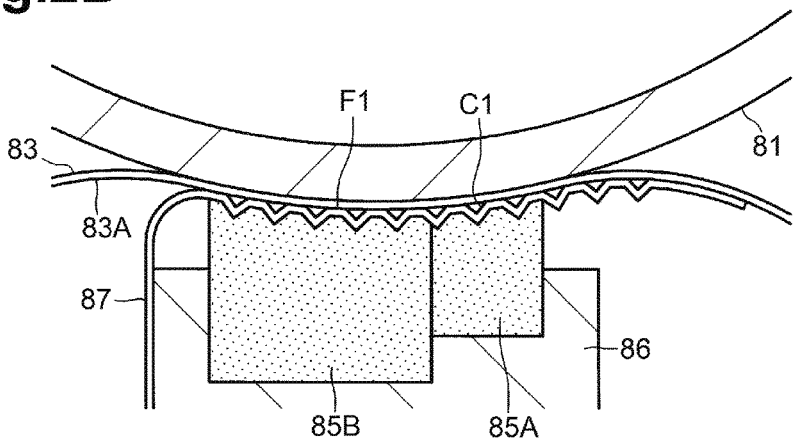
FIG. 2B is an enlarged view illustrating a nip portion and its surrounding portion in the illustrative embodiment according to one or more aspects of the disclosure.
Figure 3:
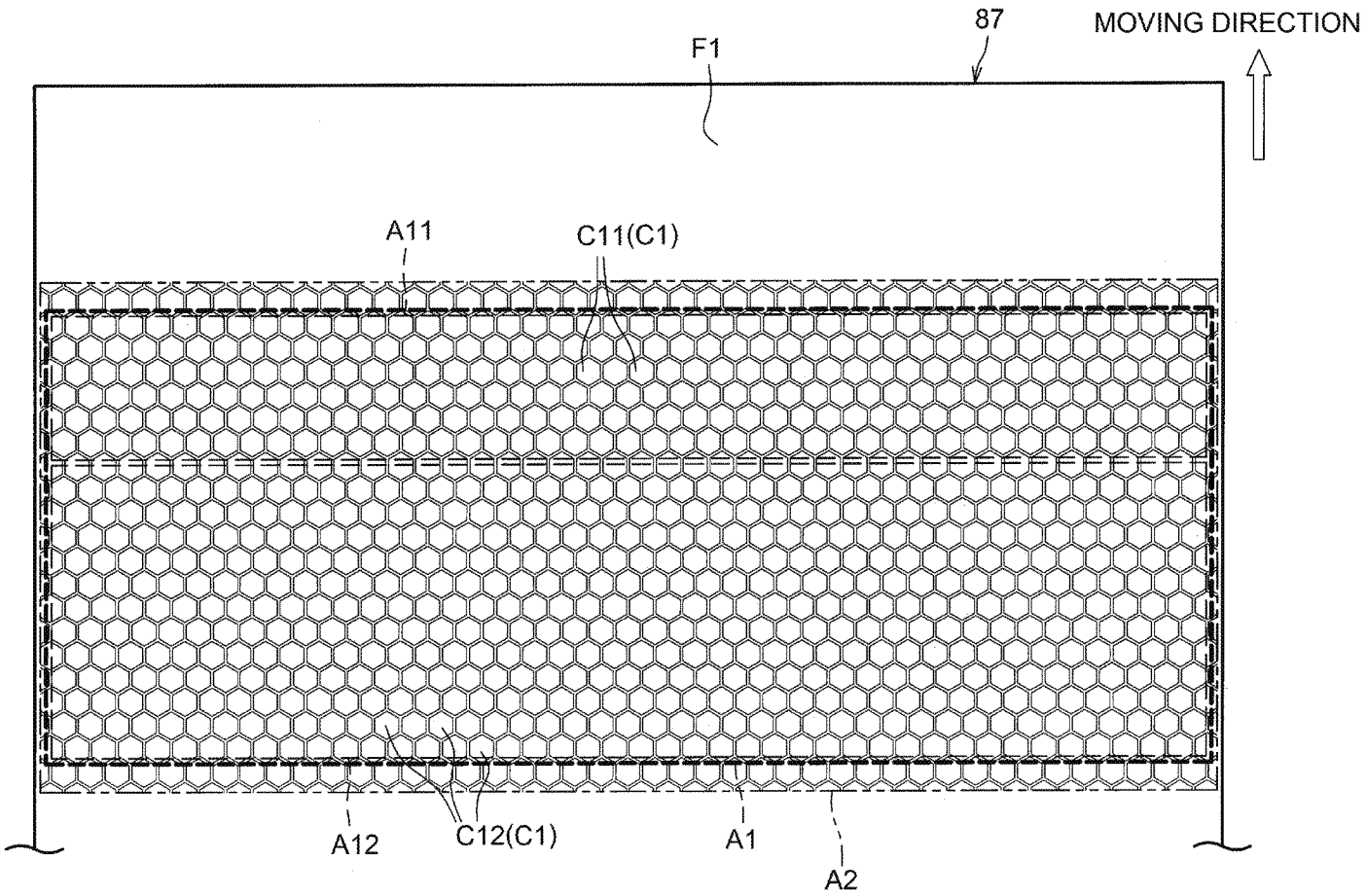
FIG. 3 illustrates a sliding sheet having a plurality of dimples including a plurality of first dimples and a plurality of second dimples in the illustrative embodiment according to one or more aspects of the disclosure.

As illustrated in FIG. 2B, the sliding sheet 87 has a surface F1 which may contact a portion of the inner circumferential surface 83A of the endless belt 83. The surface F1 of the sliding sheet 87 has a plurality of dimples C1. More specifically, for example, as illustrated in FIG. 3, the surface F1 includes a section A1, which includes most of the dimples C1. The dimples C1 included in the section A1 may occupy the section A1 entirely and be arranged in a regular pattern. The section A1 of the surface F1 corresponds to the nip portion NP. More specifically, the section A1 may receive a nip pressure applied by the heat roller 81. In the illustrative embodiment, the surface F1 further includes a section A2 including all of the dimples C1. The section A2 has the same dimension as the section A1 in the width direction but has a greater dimension than the section A1 in the moving direction. That is, the section A2 has upstream and downstream ends that protrude relative to upstream and downstream ends, respectively, of the section A1 in the moving direction.

In one example, the surface F1 may be partially defined by the section A2. In another example, the surface F1 may be entirely defined by the section A2. In still another example, the section A2 may be included within the section A1. In such a case, for example, the section A2 may be larger than the section A1 in the width direction.

The pressure pads 85A and 85B are preferably made of a material softer than the material used for the sliding sheet 87. This may enable each dimple C1 to retain its shape against pressure exerted on the sliding sheet 87 by each of the pressure pads 85A and 85B.

The dimples C1 includes dimples C11 and dimples C12. The dimples C11 all have the same shape. The dimples C12 all have the same shape but a different shape from the shape of the dimples C11. Each dimple C11 is an example of a first dimple. Each dimple C12 is an example of a second dimple. The section A1 of the surface F1 includes a zone A11, which may be applied with the first pressure. The zone A11 has the dimples C11. The section A1 of the surface F1 further includes a zone A12, which may be applied with the second pressure weaker than the first pressure. The zone A12 has the dimples C12. Some of the dimples C1 may be located on a boundary between the zone A11 and the zone A12. Such dimples C1 may have the same shape as the dimples C11 or the same shape as the dimples C12. In other embodiments, for example, the section A1 might not necessarily have any dimples C1 on the boundary between the zone A11 and the zone A12.

Figure 4A:
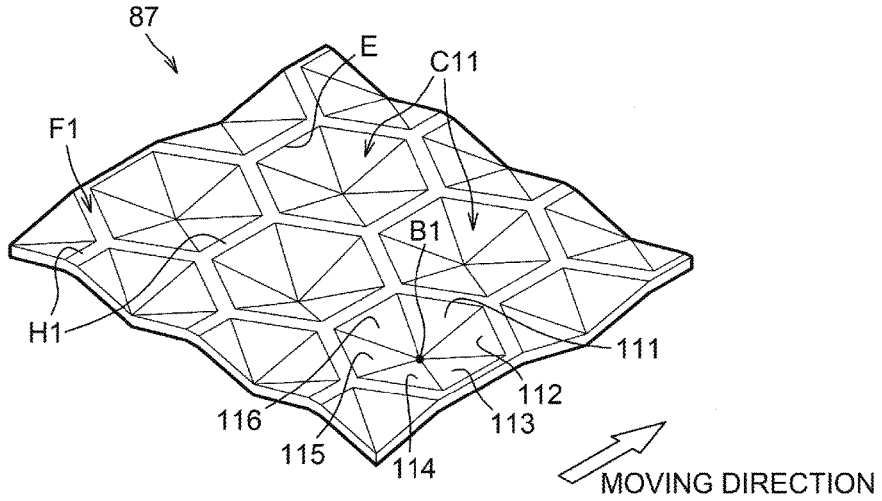
FIG. 4A is an enlarged perspective view illustrating a portion of the sliding sheet including some of the first dimples in the illustrative embodiment according to one or more aspects of the disclosure.
Figure 4B:
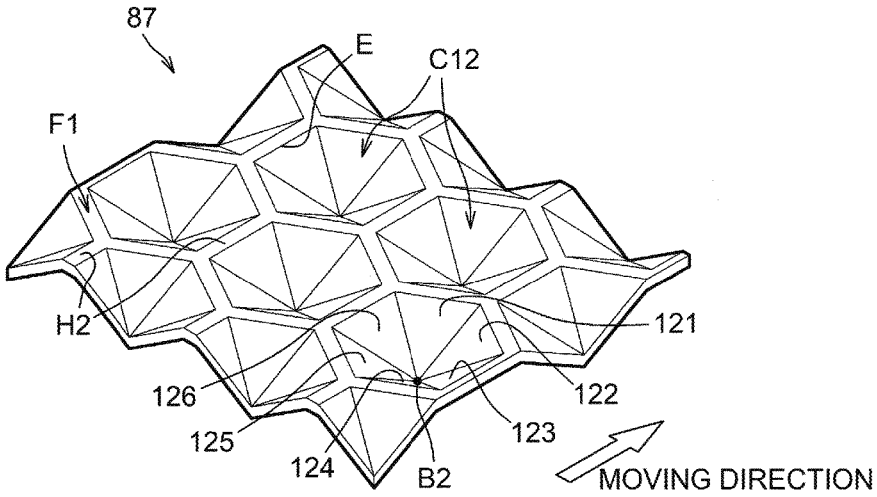
FIG. 4B is an enlarged perspective view illustrating another portion of the sliding sheet including some of the second dimples in the illustrative embodiment according to one or more aspects of the disclosure.

As illustrated in FIGS. 4A and 4B, each of the dimples C11 and C12 has an opening E having a regular hexagonal shape when viewed in a direction perpendicular to the surface F1. The dimples C11 are spaced from each other by a predetermined distance and arranged in a regular pattern, e.g., in a honeycomb lattice. Likewise, the dimples C12 are spaced from each other by a predetermined distance and arranged in a regular pattern, e.g., in a honeycomb lattice. Hereinafter, an arbitrary one of each of the dimples C11 and the dimples C12 will be described in detail, and a description for the others will be omitted as appropriate.

A dimple C11 is defined by a plurality of, for example, six, triangular inclined surfaces 111, 112, 113, 114, 115, and 116 to form an inverted hexagonal pyramid shape having a bottom B1 (e.g., a vertex). The inclined surfaces 111 and 112 are located downstream of the dimple C11 with respect to the bottom B1 in the moving direction. The inclined surface 113 and the inclined surface 116 are located opposite to each other with respect to the bottom B1 in the width direction. The inclined surfaces 114 and 115 are located upstream of the dimple C11 with respect to the bottom B1 in the moving direction.

A dimple C12 is defined by a plurality of, for example, six, triangular inclined surfaces 121, 122, 123, 124, 125, and 126 to form an inverted hexagonal pyramid shape having a bottom B2 (e.g., a vertex). The inclined surfaces 121 and 122 are located downstream of the dimple C12 with respect to the bottom B2 in the moving direction. The inclined surface 123 and the inclined surface 126 are located opposite to each other with respect to the bottom B2 in the width direction. The inclined surfaces 124 and 125 are located upstream of the dimple C12 with respect to the bottom B2 in the moving direction.

The dimple C11 has a shallower depth than the dimple C12. Each of the inclined surfaces 111 to 116 of the dimple C11 thus has more gentle inclination than each of the inclined surfaces 121 to 126 of the dimple C12, thereby enabling the dimple C11 to release lubricant in the moving direction more easily than the dimple C12.

The surface F1 of the sliding sheet 87 includes ridges H1 and ridges H2 each having a flattened top. The ridges H1 are located between the dimples C11. The ridges H2 are located between the dimples C12. More specifically, for example, each ridge H1 is located between two arbitrary adjacent dimples C11. Each ridge H2 is located between two arbitrary adjacent dimples C12.

Figure 5A:
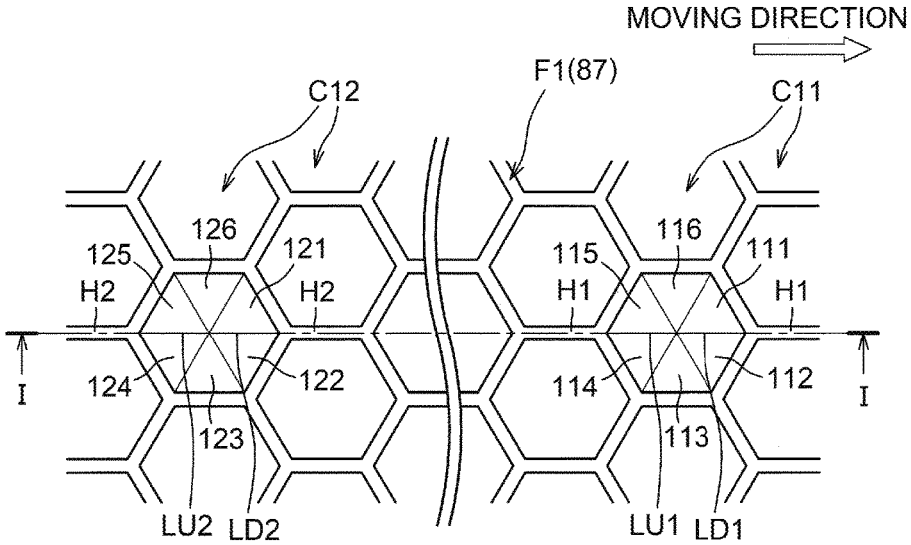
FIG. 5A is an enlarged perspective view illustrating a portion of the sliding sheet including some of the first dimples and some of the second dimples in the illustrative embodiment according to one or more aspects of the disclosure.
Figure 5B:
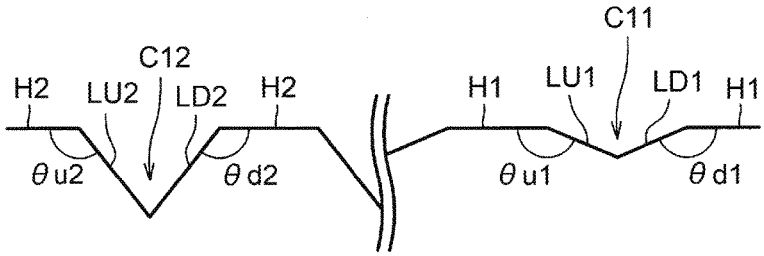
FIG. 5B is a cross-sectional view taken along line I-I of FIG. 5A in the illustrative embodiment according to one or more aspects of the disclosure.

As illustrated in FIGS. 5A and 5B, the dimple C11 includes a linear portion LD1 in its downstream portion including the inclined surface 111 and the inclined surface 112. The linear portion LD1 may be a straight line in cross section taken along the moving direction when cutting straight through the sliding sheet 87 in a direction perpendicular to the surface F1. More specifically, for example, the linear portion LD1 is located on a boundary between the inclined surface 111 and the inclined surface 112. Hereinafter, "some shape in cross section taken along the moving direction when cutting straight through the sliding sheet 87 in a direction perpendicular to the surface F1" may be simply referred to as a "cross-sectional shape" or "some shape in cross section".

The dimple C11 further includes a linear portion LU1 in its upstream portion including the inclined surface 114 and the inclined surface 115. The linear portion LD1 may be a straight line in cross section. More specifically, for example, the linear portion LU1 is located on a boundary between the inclined surface 114 and the inclined surface 115. The linear portion LD1 and a ridge H1 connecting to the linear portion LD1 forms an angle θd1. The linear portion LU1 and a ridge H1 connecting to the linear portion LU1 forms an angle θu1. The angle θd1 is equal to the angle θu1.

The dimple C12 includes a linear portion LD2 in its downstream portion including the inclined surface 121 and the inclined surface 122. The linear portion LD2 may be a straight line in cross section. More specifically, for example, the linear portion LD2 is located on a boundary between the inclined surface 121 and the inclined surface 122. The dimple C12 further includes a linear portion LU2 in its upstream portion including the inclined surface 124 and the inclined surface 125. The linear portion LD2 may be a straight line in cross section. More specifically, for example, the linear portion LU2 is located on a boundary between the inclined surface 124 and the inclined surface 125. The linear portion LD2 and a ridge H2 connecting to the linear portion LD2 forms an angle θd2. The linear portion LU2 and a ridge H2 connecting to the linear portion LU2 forms an angle θu2. The angle θd2 is equal to the angle θu2.

The angles θd1, θu1, θd2, and θu2 may each be larger than or equal to 90 degrees and smaller than 180 degrees.

The angle θd1 of the dimple C11 is larger than the angle θd2 of the dimple C12, thereby enabling the dimple C11 to release lubricant in the moving direction more easily than the dimple C12. In addition, the angle θu1 of the dimple C11 is larger than the angle θu2 of the dimple C12. More specifically, the angles θd1 and θu1 may each preferably be larger than or equal to 165 degrees, and more preferably, be larger than or equal to 170 degrees. The angles θd2 and θu2 may each preferably be smaller than 165 degrees, and more preferably, be smaller than or equal to 160 degrees.

In the illustrative embodiment, the cross-sectional shape of the dimples C1 may be a shape in cross section taken when cutting straight through the sliding sheet 87 such that a cutting plane passes through the bottom B1 of the dimple C11 and the bottom B2 of the dimple C12. Nevertheless, the dimple C11 and the dimple C12 may include such linear portions in cross section when cutting straight through the sliding sheet 87 such that a cutting plane does not pass through the bottom B1 of the dimple C11 and the bottom B2 of the dimple C12. In such a case, the relationship between the linear portions may be the same or similar to the relationship between the linear portions LD1, LU1, LD2, LU2 described above.

The illustrative embodiment may thus achieve the following effects. The dimple C11 included in the section A11 to which a stronger pressure is applied than a pressure applied to the section A12 has such a shape that tends to release lubricant in the moving direction more easily than the dimple C12. If, therefore, foreign matter such as wear dust or wear debris intrudes into the dimple C11, the dimple C11 may release the foreign matter therefrom together with lubricant, thereby reducing accumulation of foreign matter in the dimple C11. On the other hand, the dimple C12 has a higher lubricant-holding capability than the dimple C11, thereby collecting foreign matter therein.

While the disclosure has been described in detail with reference to the specific embodiment thereof, this is merely an example, and various changes, arrangements and modifications may be applied therein without departing from the spirit and scope of the disclosure. In the following alternative embodiments, an explanation will be given mainly for the parts different from the illustrative embodiment, and an explanation will be omitted for the common components by assigning the same reference numerals thereto.

In the illustrative embodiment, while the dimple C11 and the dimple C12 each have the opening E having a regular hexagonal shape, the dimple C11 and the dimple C12 have different depths. Nevertheless, the first dimple and the second dimple may have any shape if the first dimple has such a shape that tends to release lubricant therefrom in the moving direction more easily than the second dimple. Hereinafter, alternative embodiments illustrate various example first and second dimples.

Figure 6:
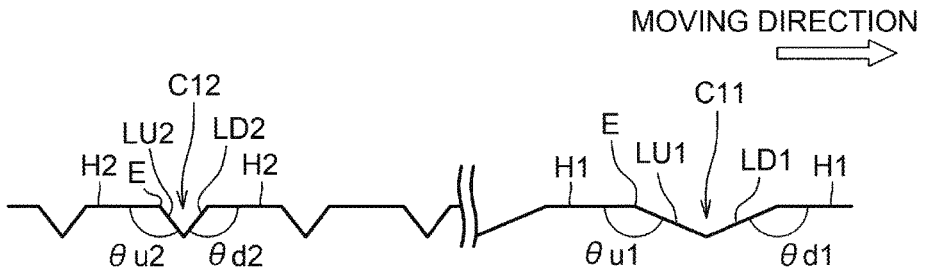
FIG. 6 is a cross-sectional view illustrating a portion of a sliding sheet including a first dimple and a second dimple in a first alternative embodiment according to one or more aspects of the disclosure.

In a first alternative embodiment, as illustrated in FIG. 6, a dimple C11 has a larger opening E than a dimple C12, and the dimple C11 and the dimple C12 have the same depth. The opening E of the dimple C12 has the same size as the opening E of the dimple C12 according to the illustrative embodiment. Further, the depth of the dimple C12 is the same as the depth of the dimple C12 according to the illustrative embodiment. A relationship between angles θd1, θd2, θu1, and θu2 according to the first alternative embodiment is the same as the relationship between the angles θd1, θd2, θu1, and θu2 according to the illustrative embodiment. Further, the angles θd1, θd2, θu1, and θu2 according to the first alternative embodiment have the same preferable range as the angles θd1, θd2, θu1, and θu2, respectively, according to the illustrative embodiment. Such a dimple C11 may thus have a larger capacity than the dimple C11 according to the illustrative embodiment, thereby enabling the zone A11, to which a stronger pressure is applied than the pressure applied to the zone A12, to retain lubricant therein sufficiently.

Figure 7:
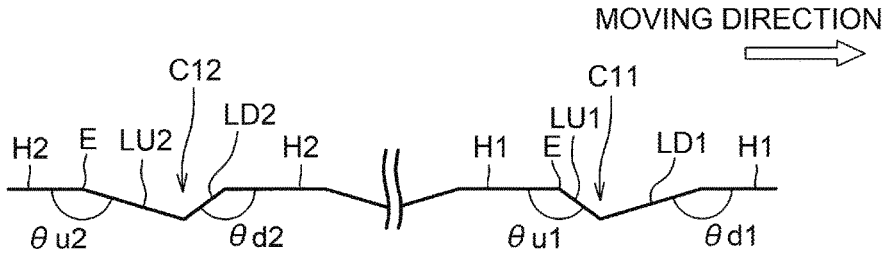
FIG. 7 is a cross-sectional view illustrating a portion of a sliding sheet including a first dimple and a second dimple in a second alternative embodiment according to one or more aspects of the disclosure.

In a second alternative embodiment, as illustrated in FIG. 7, an angle θd1 of a dimple C11 is larger than an angle θd2 of a dimple C12. Further, the angle θd1 is equal to an angle θu2 of the dimple C12, and the angle θd2 is equal to an angle θu1 of the dimple C11. The opening E of the dimple C11 and the opening E of the dimple C12 have the same shape as with the illustrative embodiment. The dimple C11 and the dimple C12 have thus the same depth.

Such a configuration may therefore enable the dimple C11 and the dimple C12 to have an equal capacity. Consequently, the dimple C11 having the angle θd1 larger than the angle θd2 of the dimple C12 may retain the same amount of lubricant as the dimple C12, thereby reducing or preventing lack of lubricant in the zone A11. The angles θd1 and θu2 may each preferably be larger than or equal to 165 degrees, and more preferably be larger than or equal to 170 degrees. The angles θu1 and θd2 may each preferably be smaller than 165 degrees, and more preferably be smaller than or equal to 160 degrees.

Figure 8:
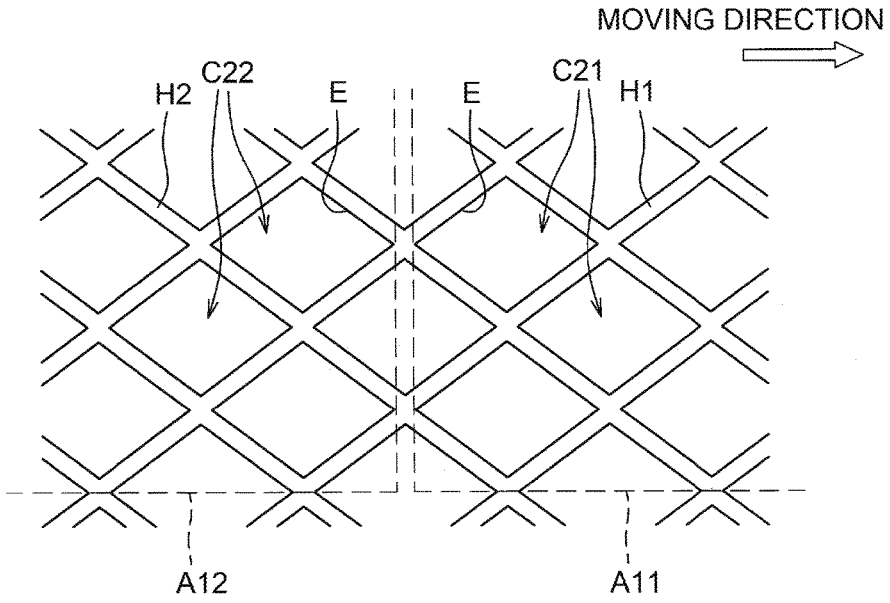
FIG. 8 is a plan view illustrating a portion of a sliding sheet including a plurality of first dimples and a plurality of second dimples in a third alternative embodiment according to one or more aspects of the disclosure.

In a third alternative embodiment, as illustrated in FIG. 8, a surface F1 of a sliding sheet 87 has a plurality of dimples C21 and a plurality of dimples C22 arranged in a regular pattern, e.g., in a lattice pattern. Each of dimples C21 and C22 has an opening E having a quadrangular shape when viewed in a direction perpendicular to the surface F1. The surface F further includes ridges H1 between the dimples C21 and ridges H2 between the dimples C22. More specifically, for example, the dimples C21 are arranged in a manner such that the ridges H1 form a lattice pattern and the dimples C22 are arranged also in a manner such that the ridges H2 form a lattice pattern. Such dimples C21 and C22 having a quadrangular shape have the same cross-sectional shapes, respectively, as the cross-sectional shapes of the dimples C11 and C12 illustrated in FIG. 5B. With this configuration, the third alternative embodiment may achieve the same effects as the illustrative embodiment.

Figure 9A:
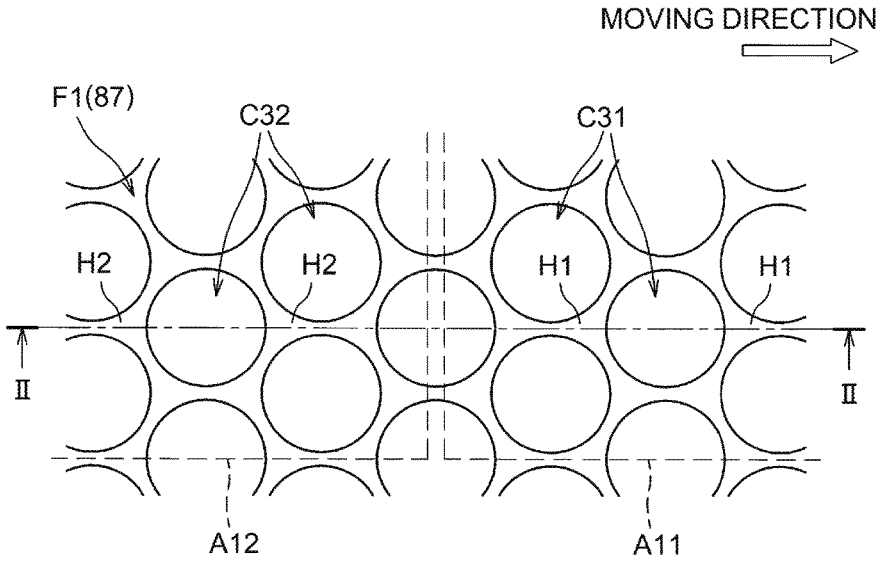
FIG. 9A is a plan view illustrating a portion of a sliding sheet including a plurality of first dimples and a plurality of second dimples in a fourth alternative embodiment according to one or more aspects of the disclosure.
Figure 9B:
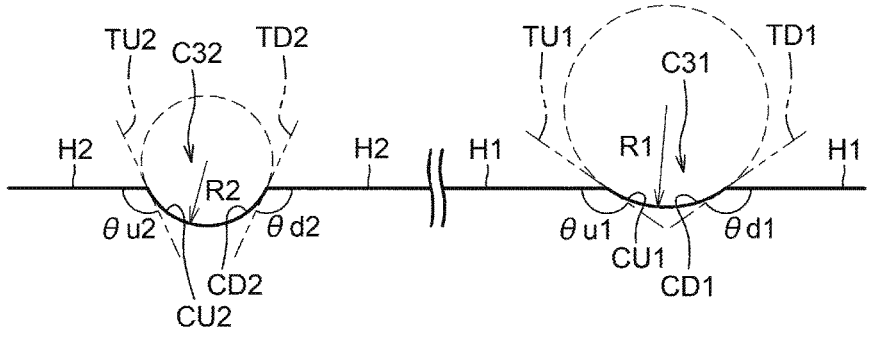
FIG. 9B is a cross-sectional view taken along line II-II of FIG. 9A in the third alternative embodiment according to one or more aspects of the disclosure.

In a fourth illustrative embodiment, as illustrated in FIGS. 9A and 9B, a surface F1 of a sliding sheet 87 has a plurality of dimples C31 and a plurality of dimples C32 arranged in a regular pattern, e.g., in a staggered pattern. Each of the dimples C31 and C32 has an opening E having a circular shape when viewed in a direction perpendicular to the surface F. Hereinafter, an arbitrary one of each of the dimples C31 and the dimples C32 will be described in detail, and a description for the others will be omitted as appropriate. Each of the dimples C31 and C32 has a spherical cap shape in cross section. The spherical shape includes any rounded shape such as an ellipsoid.

The surface F1 of the sliding sheet 87 includes ridges H1 and ridges H2 each having a flattened top. The ridges H1 are located between the dimples C31. The ridges H2 are located between the dimples C32. As illustrated in FIG. 9B, a dimple C31 includes a curved portion CD1 in its downstream portion in the moving direction and a curved portion CU1 in its upstream portion in the moving direction. Each of the curved portions CD1 and CU1 may be a curved line in cross section. A dimple C32 includes a curved portion CD2 in its downstream portion in the moving direction and a curved portion CU2 in its upstream portion in the moving direction. Each of the curved portions CD2 and CU2 may be a curved line in cross section.

The curved portion CD1 and the curved portion CU1 have the same radius of curvature, for example, a radius of curvature R1. The curved portion CD2 and the curved portion CU2 have the same radius of curvature, for example, a radius of curvature R2. The radius of curvature R1 is greater than the radius of curvature R2. The dimple C31 has a shallower depth than the dimple C32.

An imaginary tangent TD1 tangent to a downstream end of the curved portion CD1 and a ridge H1 connecting to the curved portion CD1 form an angle θd1. An imaginary tangent TD2 tangent to a downstream end of the curved portion CD2 and a ridge H2 connecting to the curved portion CD2 form an angle θd2. The angle θd1 is larger than the angle θd2.

An imaginary tangent TU1 tangent to an upstream end of the curved portion CU1 and a ridge H1 connecting to the curved portion CU1 form an angle θu1. The angle θd1 is equal to the angle θu1. An imaginary tangent TU2 tangent to an upstream end of the curved portion CU2 and a ridge H2 connecting to the curved portion CU2 form an angle θu2. The angle θd2 is equal to the angle θu2. The angles θd1, θd2, θu1, and θu2 according to the fourth alternative embodiment have the same preferable range as the angles θd1, θd2, θu1, and θu2, respectively, according to the illustrative embodiment and the first alternative embodiment.

In the fourth alternative embodiment, the angle θd1 of the dimple C31 is larger than the angle θd2 of the dimple C32. This configuration may thus enable the dimple C31 to release lubricant in the moving direction more easily than the dimple C32, thereby reducing accumulation of foreign matter in the dimple C31.

Figure 10:
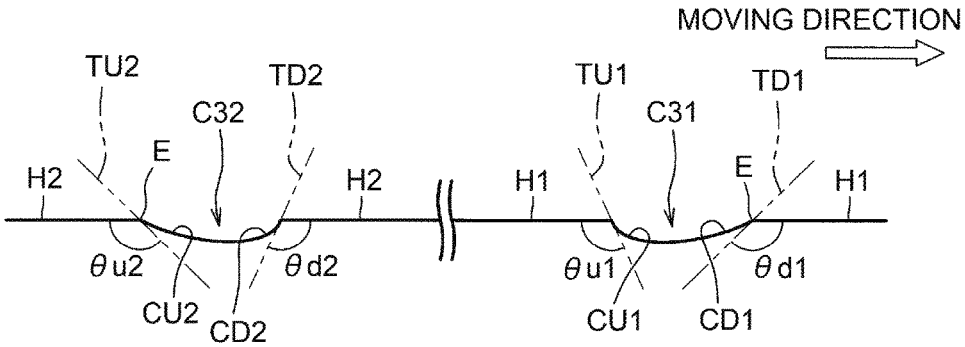
FIG. 10 is a cross-sectional view illustrating a portion of a sliding sheet including a first dimple and a second dimple in a fifth alternative embodiment according to one or more aspects of the disclosure.

In a fifth alternative embodiment, as illustrated in FIG. 10, a dimple C31 and a dimple C32 each have a spherical cap shape in cross section. An angle θd1 of the dimple C31 is larger than an angle θd2 of the dimple C32 as with the fourth alternative embodiment. Nevertheless, the angle θd1 is equal to an angle θu2 of the dimple C32 and the angle θd2 is equal to an angle θu1 of the dimple C31. The dimple C31 has an opening E having the same shape as the dimple C32. The dimple C31 and the dimple C32 have the same depth. The angles θd1, θd2, θu1, and θu2 according to the fifth alternative embodiment have the same preferable range as the angles θd1, θd2, θu1, and θu2, respectively, according to the second alternative embodiment.

Such a configuration may therefore enable the dimple C31 and the dimple C32 to have an equal capacity. Consequently, the dimple C31 having the angle θd1 larger than the angle θd2 of the dimple C32 may retain the same amount of lubricant as the dimple C32, thereby reducing or preventing lack of lubricant in the zone A11.

Figure 11:
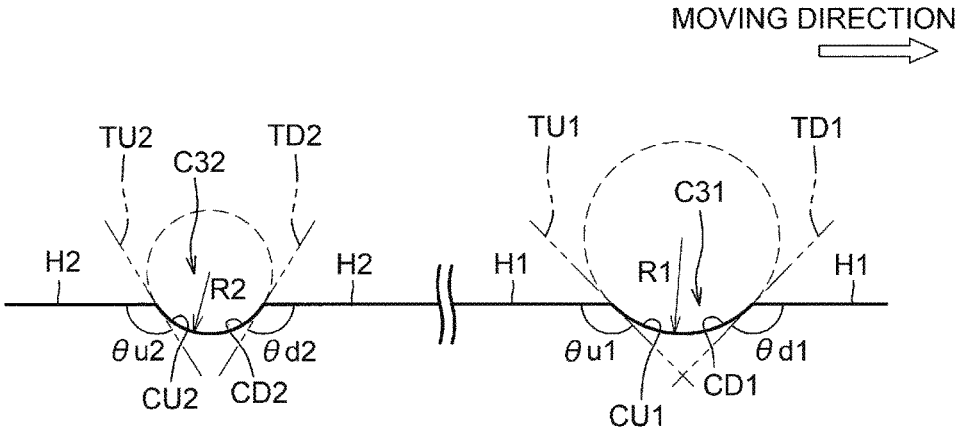
FIG. 11 is a cross-sectional view illustrating a portion of a sliding sheet including a first dimple and a second dimple in a sixth alternative embodiment according to one or more aspects of the disclosure.

In a sixth illustrative embodiment, as illustrated in FIG. 11, a dimple C31 and a dimple C32 each have a spherical cap shape in cross section. The dimples C31 and C32 have a similar configuration to the dimples C31 and C32, respectively, according to the fourth alternative embodiment except the dimples C31 and C32 according to the sixth alternative embodiment have the same depth. That is, a relationship between angles θd1, θu1, θd2, and θu2 and a relationship between the radii of curvature R1 and R2 according to the sixth alternative embodiment may be the same as the relationship between the angles θd1, θu1, θd2, and θu2 and the relationship between the radii of curvature R1 and R2 according to the fourth alternative embodiment. The angles θd1, θd2, θu1, and θu2 have the same preferable range as the angles θd1, θd2, θu1, and θu2, respectively, according to the illustrative embodiment. In the sixth alternative embodiment, the angle θd1 of the dimple C31 is larger than the angle θd2 of the dimple 32. This configuration may thus enable the dimple C31 to release lubricant in the moving direction more easily than the dimple C32, thereby reducing accumulation of foreign matter in the dimple C31.

Figure 12:
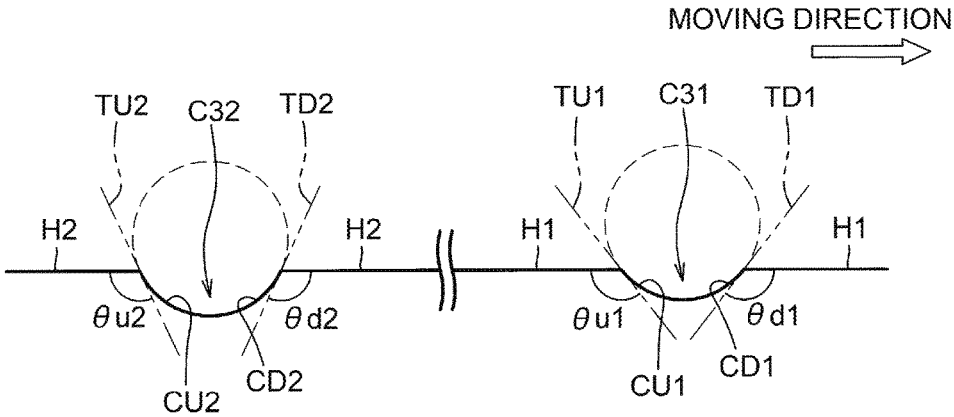
FIG. 12 is a cross-sectional view illustrating a portion of a sliding sheet including a first dimple and a second dimple in a seventh alternative embodiment according to one or more aspects of the disclosure.

In a seventh alternative embodiment, as illustrated in FIG. 12, a dimple C31 and a dimple C32 each have a spherical cap shape in cross section. The dimple C31 includes curved portions CD1 and CU1, and the dimple C32 includes curved portions CD2 and CU2. The curved portions CD1, CU1, CD2, and CU2 all have the same radius of curvature. Further, the dimple C31 has a shallower depth than the dimple C32. With this configuration, an angle θd1 of the dimple C31 is larger than an angle θd2 of the dimple C32. The angles θd1, θd2, θu1, and θu2 have the same preferable range as the angles θd1, θd2, θu1, and θu2, respectively, according to the illustrative embodiment. In the seventh alternative embodiment, the angle θd1 of the dimple C31 is larger than the angle θd2 of the dimple C32. This configuration may thus enable the dimple C31 to release lubricant in the moving direction more easily than the dimple C32, thereby reducing accumulation of foreign matter in the dimple C31.

Figure 13A:
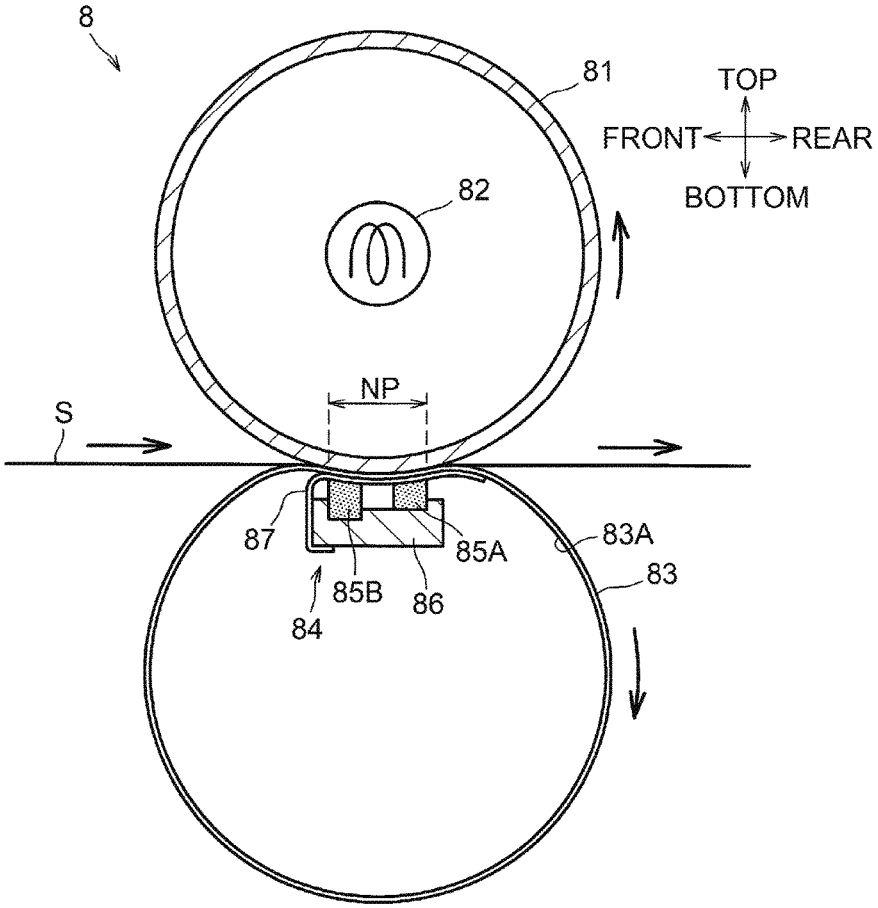
FIG. 13A is a cross-sectional view illustrating a fuser in an eighth alternative embodiment according to one or more aspects of the disclosure.
Figure 13B:
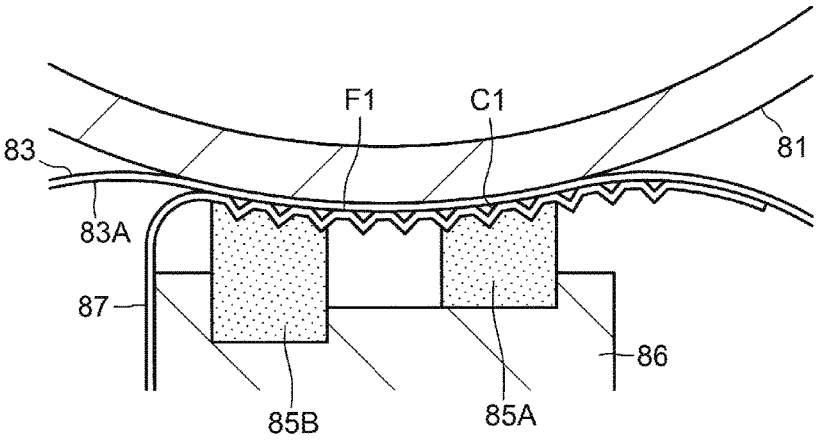
FIG. 13B is an enlarged view illustrating a nip portion and its surrounding portion in the eighth alternative embodiment according to one or more aspects of the disclosure.

In the illustrative embodiment, the pressure pad 85A is disposed downstream from the pressure pad 85B in the moving direction while contacting the pressure pad 85B. Nevertheless, in an eighth alternative embodiment, for example, as illustrated in FIGS. 13A and 13B, the pressure pad 85A may be disposed downstream from the pressure pad 85B in the moving direction while being spaced from the pressure pad 85B in the moving direction. More specifically, for example, the pressure pad 85A has the same dimensions both in the width direction and in the moving direction as the pressure pad 85B. Nevertheless, the pressure pad 85A has a thickness (e.g., a dimension in the facing direction) smaller than the pressure pad 85B. Such a configuration may thus enable the pressure pad 85A to apply the first pressure to the sliding sheet 87 and the pressure pad 85B to apply the second pressure to the sliding sheet 87. The second pressure is weaker than the first pressure.

The sliding sheet 87 includes a particular portion corresponding to a space between the pressure pad 85A and the pressure pad 85B. The particular portion is under pressure of the pressure pad 85A and/or pressure of the pressure pad 85B. Thus, the nip portion NP is defined between a downstream end of the pressure pad 85A and an upstream end of the pressure pad 85B in the moving direction.

Figure 14:
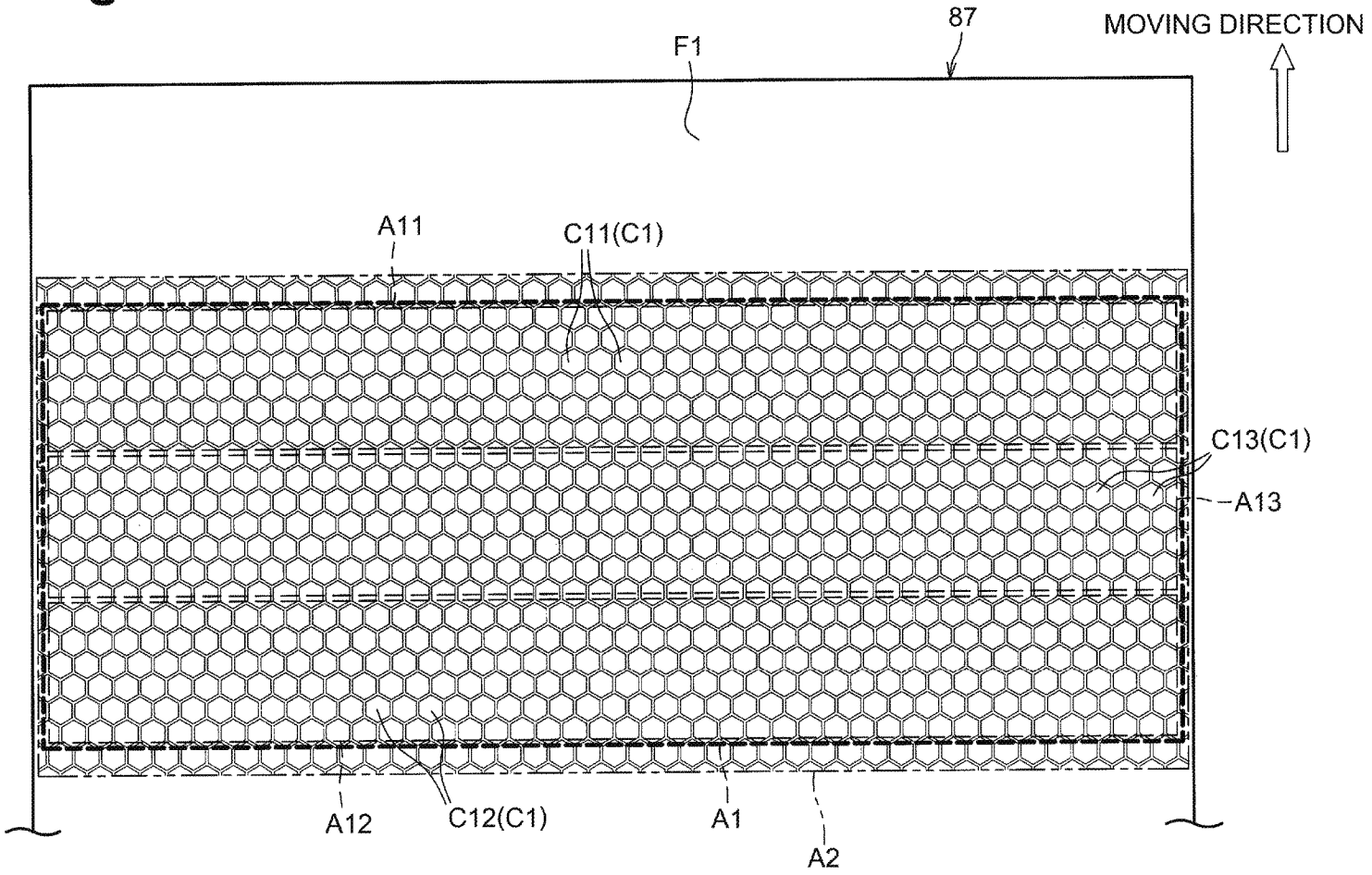
FIG. 14 is a plan view illustrating a sliding sheet having a plurality of dimples including a plurality of first dimples, a plurality of second dimples, and a plurality of third dimples in the eighth alternative embodiment according to one or more aspects of the disclosure.

As illustrated in FIG. 14, a surface F1 of a sliding sheet 87 has a plurality of dimples C1. The dimples C1 includes dimples C13 as well as dimples C11 and dimples C12. The dimples C11 and the dimples C12 have the same or similar shape to the dimples C11 and the dimples C12 according to the illustrative embodiment. The dimples C13 have a different shape from the shape of the dimples C11 and the dimples C12. Each dimple C13 is an example of a third dimple. The surface F1 includes a section A1. The section A1 includes a zone A11, which may be applied with the first pressure. The zone A11 has the dimples C11. The section A1 further includes a zone A12, which may be applied with the second pressure weaker than the first pressure. The zone A12 has the dimples C12.

The section A1 further includes a zone A13 between the zone A11 and the zone A12 in the moving direction. The zone A13 does not overlap the zone A11 and the zone A12. The zone A13 is applied with a pressure weaker than the second pressure.

Some of the dimples C1 may be located on a boundary between the zone A11 and the zone A13. Such dimples C1 may have the same shape as the dimples C11 or as the dimples C13. Likewise, some of the dimples C1 may be located on a boundary between the zone A12 and the zone A13. Such dimples C1 may have the same shape as the dimples C12 or as the dimples C13. In other embodiments, for example, the section A1 might not necessarily have any dimples C1 on the boundary between the zone A11 and the zone A12 and on the boundary between the zone A12 and the zone A13.

Figure 15A:
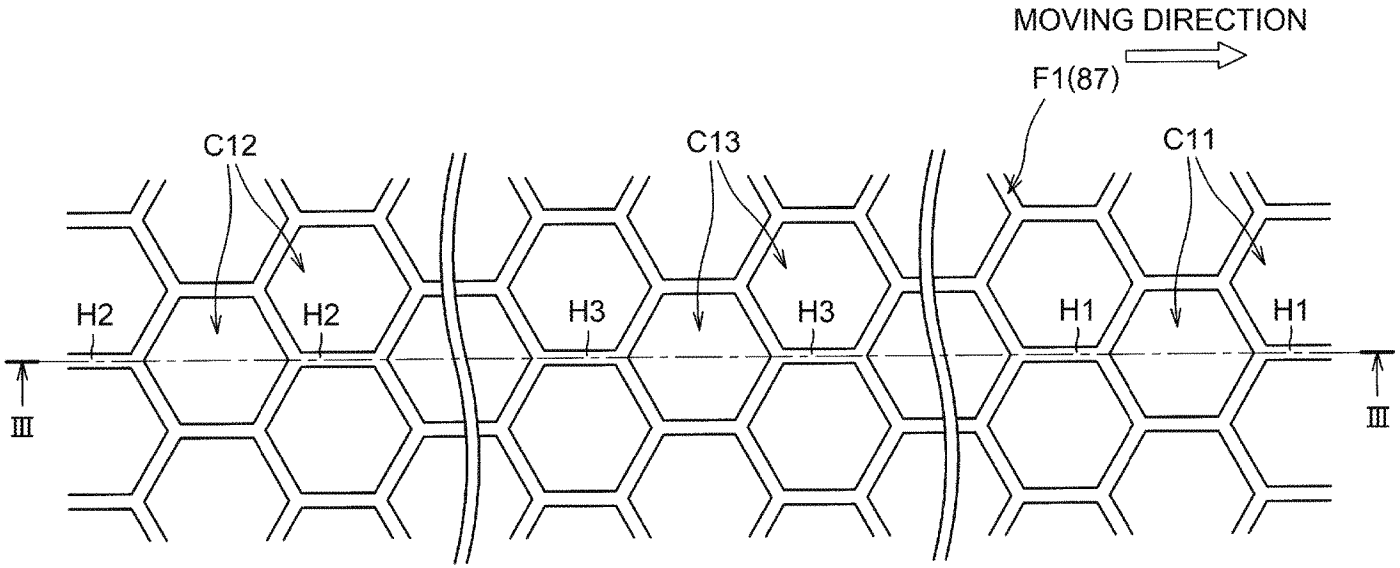
FIG. 15A is an enlarged perspective view illustrating a portion of the sliding sheet including some of the first dimples, some of the second dimples, and some of the third dimples in the eighth alternative embodiment according to one or more aspects of the disclosure.
Figure 15B:
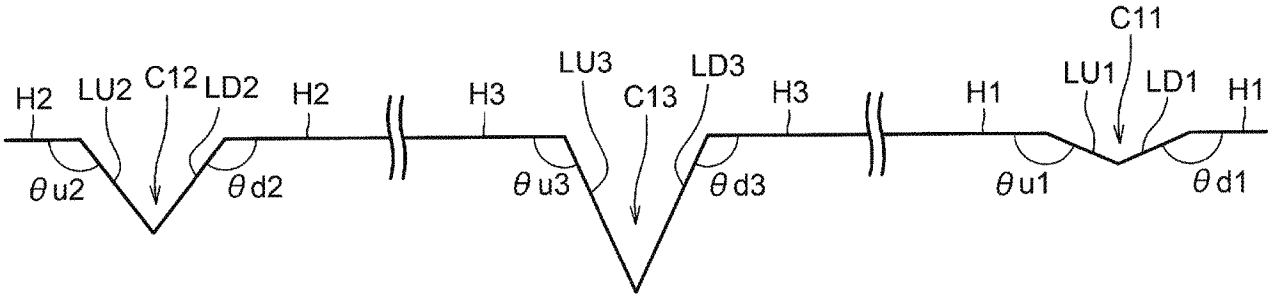
FIG. 15B is a cross-sectional view taken along line of FIG. 15A in the eighth alternative embodiment according to one or more aspects of the disclosure.

As illustrated in FIG. 15A, the surface F1 of the sliding sheet 87 includes ridges H3 each having a flattened top as well as ridges H1 and ridges H2. The ridges H3 are located between the dimples C13. As illustrated in FIG. 15B, a dimple C13 includes a linear portion LD3 in its downstream portion in the moving direction and a linear portion LU3 in its upstream portion in the moving direction. Each of the curved portions LD1 and LU1 may be a straight line in cross section.

The linear portion LD3 and a ridge H3 connecting to the linear portion LD3 forms an angle θd3. The angle θd3 is smaller than an angle θu1 of a dimple C11. More specifically, for example, the angle θd3 is smaller than an angle θd2 of a dimple C12. The linear portion LU3 and a ridge H3 connecting to the linear portion LD3 forms an angle θu3. The angle θd3 is equal to the angle θu3.

The angles θd1, θu1, θd2, θu2, θd3, and θu3 may each be larger than or equal to 90 degrees and smaller than 180 degrees. More specifically, the angles θd1 and θu1 may preferably be larger than or equal to 165 degrees, and may more preferably be larger than or equal to 170 degrees. The angles θd2 and θu2 may each preferably be smaller than 165 degrees, and more preferably be smaller than or equal to 160 degrees. The angles θd3 and θu3 may preferably be smaller than 160 degrees, and more preferably be smaller than or equal to 155 degrees.

In the eighth alternative embodiment, the angle θd3 is smaller than the angle θd1. This configuration may thus enable the dimple C13 to have a higher lubricant-holding capability than the dimple C11, thereby collecting foreign matter therein in addition to the dimple C12. In particular, the angle θd3 of the dimple C13 is smaller than the angle θd2 of the dimple C12. This configuration may thus enable the dimple C13 to have a higher lubricant-holding capability than the dimple C12. The zone A13, to which a pressure smaller than the second pressure is applied, may thus collect foreign matter therein primarily.

In other embodiments, for example, the zone A13 having the dimples C13 may be located outside of the section A1. More specifically, for example, the sliding sheet 87 may have the zone A13 at a position downstream from the nip portion NP in the moving direction and where the zone A13 can contact the inner circumferential surface 83A of the endless belt 83. Such a configuration may thus enable the dimples C13 to collect foreign matter primarily out of the section A1.

Figure 16:
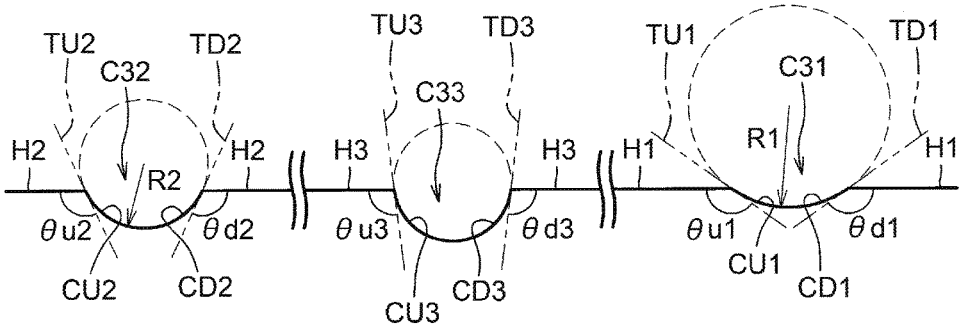
FIG. 16 is a cross-sectional view illustrating a portion of a sliding sheet including a first dimple, a second dimple, and a third dimple in a ninth alternative embodiment according to one or more aspects of the disclosure, wherein the third dimple has a spherical cap shape.

The third dimples may have any shape. For example, as illustrated in FIG. 16, each third dimple may have a spherical cap shape in cross section. In such a case, a dimple C33 includes a curved portion CD3 in its downstream portion in the moving direction and a curved portion CU3 in its upstream portion in the moving direction. Each of the curved portions CD2 and CU2 may be a curved line in cross section. An imaginary tangent TD3 tangent to a downstream end of the curved portion CD3 and a ridge H3 connecting to the curved portion CD3 forms an angle θd3. The angle θd3 is smaller than an angle θd1 of a dimple C31. More specifically, for example, the angle θd3 is smaller than an angle θd2 of a dimple C32.

In this example, the angle θd3 of the dimple C33 is smaller than the angle θd1 of the dimple C31 or the angle θd2 of the dimple C32. This configuration may thus enable the dimple C33 to have a relatively higher lubricant-holding capability, thereby collecting foreign matter therein primarily.

In the illustrative embodiment and the alternative embodiments, the nip forming member includes the pressure pad 85A and the pressure pad 85B that are separate parts. Nevertheless, in other embodiments, for example, the nip forming member may include a first pressure portion and a second pressure portion that have a one-piece body and are inseparable. The first pressure portion may be configured to apply the first pressure. The second pressure portion may be configured to apply the second pressure. The first pressure portion may be disposed upstream from the second pressure portion in the moving direction.

In the illustrative embodiment and the alternative embodiments, the fuser is configured to apply the first pressure and the second pressure at the respective different positions in the moving direction. Nevertheless, in other embodiments, for example, a fuser may be configured to apply the first pressure and the second pressure at the respective different positions in the width direction. Such a fuser may include, for example, a single rectangular pressure pad, which may be used as the nip forming member, and a heat roller having a reverse crown shape. The heat roller has end portions in an axial direction each having an outer diameter larger than its middle portion. Such a roller may apply a greater pressure to end portions of the pressure pad than to a middle portion of the pressure pad in the width direction. In this example, therefore, a sliding sheet may have a plurality of first dimples in its end portions, to which the first pressure greater than the second pressure may be applied, and a plurality of second dimples in its middle portion, to which the second pressure is applied. In another example, the nip forming member may have uneven thickness or rigidity in the width direction to include the first pressure portion and the second pressure portion at the respective different positions in the width direction. In this example, also, a sliding sheet may have a plurality of first recesses in a zone corresponding to the first pressure portion and a plurality of second recesses in another zone corresponding to the second pressure portion.

In the illustrative embodiment, the pressure pad 85 that may be an elastic member made of, for example, rubber, is used as the nip forming member. Nevertheless, in other embodiments, for example, the nip forming member may have a plate shape and be made of rigid material such as resin, plastic or metal that is not elastically deformable under application of pressure. The nip forming member and the holder 86 may have a one-piece structure and may be inseparable. Nevertheless, the use of the rigid nip forming member may cause an increase in the sliding resistance between the sliding sheet and the endless belt by flattening dimples on the surface of the sliding sheet due to long-term use of the sliding sheet and/or cause deterioration of image quality by impressions of the dimple patterns of the sliding sheet on the endless belt. For those reasons, it is preferable that the nip forming member include an elastic member such as rubber that may be elastically deformable in response to the dimple patterns of the sliding sheet under pressure.

In the illustrative embodiment, the halogen lamp is used as the heater 82. Nevertheless, in other embodiments, for example, a carbon heater may be used as the heater 82.

In the illustrative embodiments, the heat roller 81 including the heater 82 in its internal space is used as the cylindrical member. Nevertheless, in other embodiments, for example, an endless belt whose inner circumferential surface may be heated by a heater may be used as the cylindrical member. In another example, a heater may be disposed outside the cylindrical member and may heat an outer circumferential surface of the cylindrical member. In still another example, an induction heating ("IH") method may be used. In yet another example, a heater may be disposed inside the loop of the endless belt and may indirectly heat a cylindrical member contacting the outer circumferential surface of the endless belt. In still yet another example, a cylindrical member and an endless belt each may include a heat in its internal space.

In the illustrative embodiment, the fuser 8 includes the configuration for forming a nip portion. Nevertheless, in other embodiments, for example, another device or unit, for example, a sheet conveying system, may include such a configuration. For example, the configuration of the disclosure may be applied to a sheet conveying system that includes conveying rollers and a sheet conveying belt for conveying a sheet. More specifically, for example, the configuration of the disclosure may be provided inside a loop of the sheet convening belt.

The configuration for forming a nip portion is not limited to the specific example (e.g., the fuser 8). In other embodiments, for example, a fuser may include a fusing roller, a pressure roller for forming a nip portion together with the fusing roller, and a heat unit for contacting the fusing roller with a predetermined nip pressure to heat the fusing roller. The fuser may be configured to fuse a toner image onto a sheet at the nip portion. Such a fuser may include the configuration according to the disclosure in the heat unit. More specifically, for example, in a case where the heat unit includes an endless belt, and a heat member that sandwiches the endless belt with the fusing roller, a sliding sheet may be provided between the heat member and the endless belt.

In the illustrative embodiment and the alternative embodiments, the disclosure has been applied to the laser printer 1. Nevertheless, in other embodiments, for example, the disclosure may be applied to other image forming apparatuses, such as copying machines and multifunction devices.

The one or more aspects of the disclosure may be implemented in various combinations of the elements described in the illustrative embodiments and alternative embodiments.

What is claimed is:

1. A fuser comprising:

a rotatable member;

a belt comprising:

an inner peripheral surface, and an outer peripheral surface facing the rotatable member;

a heater configured to heat the rotatable member;

a pressure member configured to, with the rotatable member, sandwich the belt to form a nip portion; and a sliding member, a portion of the sliding member configured to be sandwiched between the inner peripheral surface of the belt and a surface of the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member and a plurality of second dimples arranged in a second zone of the sliding member outside the first zone, the first zone corresponding to a first part of the nip portion, to which a first pressure is to be applied, and the second zone corresponding to a second part of the nip portion, to which a second pressure smaller than the first pressure is to be applied, wherein the first dimples comprise a first upstream dimple and a first downstream dimple, positioned downstream from the first upstream dimple in a moving direction of the belt at the nip portion, wherein a first ridge portion is formed between the first upstream dimple and the first downstream dimple, wherein the second dimples comprise a second upstream dimple and a second downstream dimple positioned downstream from the second upstream dimple in the moving direction, wherein a second ridge portion is formed between the second upstream dimple and the second downstream dimple, and wherein, a first angle formed between the first upstream dimple and the first ridge portion is greater than a second angle formed between the second upstream dimple and the second ridge portion.

2. The fuser according to claim 1, wherein a third angle formed between the first downstream dimple and the first ridge portion is equal to the second angle, and wherein a fourth angle formed between the second downstream dimple and the second ridge portion is equal to the first angle.

3. The fuser according to claim 1, wherein a third angle formed between the first downstream dimple and the first ridge portion is equal to the first angle, and wherein a fourth angle formed between the second downstream dimple and the second ridge portion is equal to the second angle.

4. The fuser according to claim 1, wherein the front surface further comprises a plurality of third dimples arranged in a third zone of the sliding member outside of the first zone and the second zone, wherein the third dimples comprise a third upstream dimple and a third downstream dimple positioned downstream from the first upstream dimple in the moving direction to form a third ridge portion between the third upstream dimple and the third downstream dimple, and wherein a third angle formed between the third upstream dimple and the third ridge portion is smaller than the first angle.

5. The fuser according to claim 4, wherein the third zone corresponds to a third part of the nip portion, to which a third pressure smaller than the second pressure is to be applied, and wherein the third angle is smaller than the second angle.

6. The fuser according to claim 4, wherein the third zone is positioned between the first zone and the second zone in the nip portion.

7. The fuser according to claim 4, wherein the third zone corresponds to an area of the sliding member other than the portion of the sliding member configured to be sandwiched between the inner peripheral surface of the belt and the pressure member at a position corresponding to the nip portion.

8. The fuser according to claim 1, wherein each of the first dimples and each of the second dimples have a hexagonal pyramid shape.

9. The fuser according to claim 8, wherein, in a direction perpendicular to the moving direction, each of the first dimples and each of the second dimples are arranged in a honeycomb lattice.

10. The fuser according to claim 1, wherein each of the first dimples and each of the second dimples have a quadrangular shape.

11. The fuser according to claim 10, wherein, in a direction perpendicular to the moving direction, each of the first dimples and each of the second dimples are arranged in a lattice.

12. The fuser according to claim 1, wherein each of the first dimples and each of the second dimples have a spherical cap shape.

13. The fuser according to claim 1, wherein a depth of each of the first dimples is equal to a depth of each of the second dimples.

14. The fuser according to claim 1, wherein the pressure member includes a first pressure portion configured to apply the first pressure at the first part of the nip portion and a second pressure portion configured to apply the second pressure at the second part of the nip portion, and wherein the first pressure portion is positioned downstream from the second pressure portion in a moving direction of the belt at the nip portion.

15. The fuser according to claim 1, wherein the sliding member comprises polyimide resin.

16. The fuser according to claim 1, wherein the rotatable member comprises a roller, and wherein the heater is disposed in an interior space of the roller.

17. The fuser according to claim 1, wherein the pressure member comprises an elastic pad.

18. The fuser according to claim 1, wherein the inner peripheral surface has lubricant thereon.

19. A fuser comprising:

a rotatable member;

a belt comprising:

an inner peripheral surface, and an outer peripheral surface facing the rotatable member;

a heater configured to heat the rotatable member;

a pressure member positioned to, with the rotatable member, sandwich the belt to form a nip portion; and a sliding member, a portion of the sliding member configured to be sandwiched between the inner peripheral surface of the belt and a surface of the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member and a plurality of second dimples arranged in a second zone of the sliding member outside the first zone, the first zone corresponding to a first part of the nip portion, to which a first pressure is to be applied, and the second zone corresponding to a second part of the nip portion, to which a second pressure smaller than the first pressure is to be applied, wherein the first dimples comprise a first upstream dimple and a first downstream dimple, positioned downstream from the first upstream dimple in a moving direction of the belt at the nip portion, wherein a first ridge portion is formed between the first upstream dimple and the first downstream dimple, wherein the second dimples comprise a second upstream dimple and a second downstream dimple positioned downstream from the second upstream dimple in the moving direction, wherein a second ridge portion is formed between the second upstream dimple and the second downstream dimple, and wherein a slope of an edge of the first upstream dimple in the moving direction relative to the first ridge portion is steeper than a slope of an edge of the second upstream dimple in the moving direction relative to the second ridge portion.

20. A fuser comprising:

a rotatable member;

a belt comprising:

an inner peripheral surface, and an outer peripheral surface facing the rotatable member;

a heater configured to heat the rotatable member;

a pressure member positioned to, with the rotatable member, sandwich the belt to form a nip portion; and a sliding member, a portion of the sliding member configured to be sandwiched between the inner peripheral surface of the belt and a surface of the pressure member at a position corresponding to the nip portion, the sliding member comprising a front surface facing the inner peripheral surface of the belt and a back surface facing the pressure member, wherein the front surface comprises a plurality of first dimples arranged in a first zone of the sliding member and a plurality of second dimples arranged in a second zone of the sliding member outside the first zone, the first zone corresponding to a first part of the nip portion, to which a first pressure is to be applied, and the second zone corresponding to a second part of the nip portion, to which a second pressure smaller than the first pressure is to be applied, wherein an opening of each of the first dimples and an opening of each of the second dimples have same size, and wherein a depth of each of the first dimples is less than a depth of each of the second dimples.

* * * * *